US009538794B2

(12) United States Patent
Turlan

(10) Patent No.: US 9,538,794 B2
(45) Date of Patent: Jan. 10, 2017

(54) KNITTED BRA HAVING VARIABLE ELASTICITY

(71) Applicant: DBAPPAREL OPERATIONS, Rueil-Malmaison (FR)

(72) Inventor: Manon Turlan, Marmagne (FR)

(73) Assignee: Hanes Operations Europe SAS, Rucil, Malmaison ( * ) Notice: Subject to any disclaimer, the term of this patent is extended or adjusted under 35 U.S.C. 154(b) by 0 days.

(21) Appl. No.: 14/442,706

(22) PCT Filed: Nov. 13, 2013

(86) PCT No.: PCT/FR2013/052722
§ 371 (c)(1),
(2) Date: May 13, 2015

(87) PCT Pub. No.: WO2014/076413
PCT Pub. Date: May 22, 2014

(65) Prior Publication Data

US 2016/0242472 A1 Aug. 25, 2016

(30) Foreign Application Priority Data

Nov. 13, 2012 (FR) ..... 12 60761
Nov. 19, 2012 (FR) ..... 12 60949

(51) Int. Cl.
*A41C 3/00* (2006.01)
*D04B 1/18* (2006.01)
(Continued)

(52) U.S. Cl.
CPC ..... *A41C 3/0007* (2013.01); *A41F 15/00* (2013.01); *D04B 1/18* (2013.01); *D04B 1/246* (2013.01)

(58) Field of Classification Search
CPC ..... A41C 3/0007; A41C 3/00; D04B 1/24
(Continued)

(56) References Cited

U.S. PATENT DOCUMENTS 2,516,129 A 7/1950 Leo et al.
2,826,202 A 3/1958 Sidney
(Continued)

FOREIGN PATENT DOCUMENTS

CN 1977681 A 6/2007
DE 202012003154 U1 7/2012
(Continued)

OTHER PUBLICATIONS

The State Intellectual Property of the People's Republic of China, Notification of the First Office Action, Chinese Application No. 2013800556425, Apr. 8, 2016, 7 pages.
(Continued)

*Primary Examiner* — Gloria Hale
(74) *Attorney, Agent, or Firm* — Fish & Richardson P.C.

(57) ABSTRACT

The invention relates to a knitted bra (10), comprising at least a first knitted cup (12*a*) and a second knitted cup (12*b*) which are transversely aligned and each have an overall hemispheric shape, each cup (12*a*, 12*b*) comprising a first elastically extensible knitted peripheral portion for supporting the chest, a stiffener (20) portion which extends at least partially under each cup (12*a*, 12*b*), and a strap (14) for attaching the back of the bra (10), characterized in that the stiffener (20) forms an underwiring strip which at least partially surrounds the first peripheral supporting portion (30*a*, 30*b*) of each cup (12*a*, 12*b*), and in that the stiffener (20) is knitted in a first type of stitch designed for replacing an added underwiring.

19 Claims, 2 Drawing Sheets

(51) Int. Cl.
*D04B 1/24* (2006.01)
*A41F 15/00* (2006.01)

(58) Field of Classification Search
USPC ..... 450/74–76, 19–22, 65–70
See application file for complete search history.

(56) References Cited

U.S. PATENT DOCUMENTS

| | | | | |
|---|---|---|---|---|
| 4,531,525 | A | 7/1985 | Richards | |
| 6,101,630 | A | 8/2000 | Lee | |
| 6,142,852 | A | 11/2000 | Lerolle-Lelorrain | |
| 6,287,168 | B1 * | 9/2001 | Rabinowicz | A41C 3/0007 450/156 |
| 6,685,534 | B2 * | 2/2004 | Mitchell | D04B 1/24 450/74 |
| 7,163,432 | B2 * | 1/2007 | Mitchell | D04B 1/24 450/65 |
| 8,047,891 | B1 | 11/2011 | Albritton | |
| 2004/0110447 | A1 | 6/2004 | Mitchell et al. | |
| 2010/0267312 | A1 | 10/2010 | Chien | |

FOREIGN PATENT DOCUMENTS

| | | | |
|---|---|---|---|
| FR | 2972905 | A1 | 9/2012 |
| GB | 484367 | A | 5/1938 |
| GB | 2386382 | A | 9/2003 |
| WO | 2006025754 | A1 | 3/2006 |

OTHER PUBLICATIONS

International Search Report issued Mar. 28, 2014 re: Application No. PCT/FR2013/052709; citing: U.S. Pat. No. 6,142,852 A, FR 2 972 905 A1, GB 484 367 A and WO 2006/025754 A1.

International Search Report issued Mar. 28, 2014 re: Application No. PCT/FR2013/052723; citing: U.S. Pat. No. 2,826,202 A, U.S. Pat. No. 2010/267312 A1, U.S. Pat. No. 8,047,891 B1, U.S. Pat. No. 2,516,129 A, U.S. Pat. No. 6,101,630 A and DE 20 2012 003154 U1.

International Search Report issued Feb. 3, 2014 re: Application No. PCT/FR2013/052722; citing: GB 2 386 382 A and U.S. Pat. No. 7,163,432 B2.

* cited by examiner

KNITTED BRA HAVING VARIABLE ELASTICITY

TECHNICAL FIELD

The invention relates to a brassiere which is made of circular knit-fabric and which includes a plurality of portions having variable elasticity.

BACKGROUND

It is known to make a knit-fabric brassiere, in particular circular or tubular knit-fabric brassiere, such as the brassiere described and shown in the document U.S. Pat. No. 4,531,525.

This brassiere type, which is made by means of a circular knitting machine provided for this end, has the advantage of being comfortable to wear and of offering some flexibility and elastic extensibility.

A brassiere described and shown in the document U.S. Pat. No. 7,163,432, which aims in particular to propose a brassiere adjustable to different sizes, is also known.

According to this document, the brassiere includes a first knitted cup and a second knitted cup which are transversely aligned and each have a generally hemispherical shape.

Conventionally, the brassiere includes a strip for attaching the back and a pair of straps.

Each cup includes a first lower peripheral portion which is made of knit-fabric, for supporting the chest.

Complementarily, each cup is supported by a lower tubular added underwire forming a stiffener, which is sewn or glued under each cup.

Although this type of brassiere offers some elasticity, allowing to adapt to different sizes, the added underwire risks to cause discomfort to the person wearing the brassiere.

In addition, the underwire attachment on the brassiere requires an additional manufacturing operation.

BRIEF SUMMARY

To overcome these drawbacks in particular, the invention proposes a brassiere made of knit-fabric, of the type including at least:

a first knitted cup and a second knitted cup which are transversely aligned and which have each a generally hemispherical shape, each cup including a first elastically extensible peripheral portion which is made of knit-fabric, for supporting the chest, a part forming a stiffener which extends at least partially under each cup, and a strip for attaching the back of the brassiere, characterized in that the stiffener forms an underwire strip which surrounds at least partially the first peripheral supporting portion of each cup, and in that the stiffener is made of knit-fabric according to a first type of stitch designed to replace an added underwire.

Thus, the invention allows to provide a brassiere allowing an optimal chest holding without the need to resort to added underwires nor to thermoformed cups.

According to another characteristic, the stiffener has a low or null elastic extensibility according to a vertical direction, perpendicular to a transverse direction, so as to support the chest.

In addition, the first peripheral supporting portion of each cup has a vertical elastic extensibility superior to that of the stiffener, and in that said first portion is vertically responsive, so as to lift the chest without crushing it.

Also, each cup includes a second inner annular portion which is adjacent to the first portion, which is transversely and vertically elastically extensible, and which has a vertical and transverse elastic extensibility superior or equal to that of the first portion.

The second portion allows in particular to give depth to the cups when the brassiere is worn.

According to another aspect, the stiffener and the first portion of each cup includes a number of stitches per unit area which is inferior to the number of stitches per unit area of the second portion of each cup, to make the stiffener and said first portion less transversely extensible than the second portion.

In addition, each cup includes a third central portion which is adjacent to the second portion, which has a generally circular shape arranged generally at the center of the associated cup, and which has a vertical and transverse elastic extensibility inferior to that of the nearby second portion.

Similarly, the third portion includes a number of stitches per unit area which is inferior to the number of stitches per unit area of the second portion of each cup, to make the third portion less transversely extensible than the second portion.

Also, each portion of each cup is made of knit-fabric according to a different stitch type.

In addition, the stiffener forms a central strip which connects the first cup and the second cup together so as to limit their transverse spacing.

Finally, the different portions of each cup, the stiffener and the strip for attaching the back are made in one piece by circular knitting.

This characteristic allows to make a large part of the brassiere according to the invention on a circular knitting machine in one single knitting step.

BRIEF DESCRIPTION OF THE DRAWINGS

Other characteristics and advantages of the invention will become apparent upon reading the detailed description which follows for the understanding of which reference will be made to the appended drawings in which.

DETAILED DESCRIPTION

To clarify the description and the claims, the longitudinal, vertical and transverse terminology will be adopted without limitation, with reference to trihedral L, V, T indicated in the figures.

Figure 1:
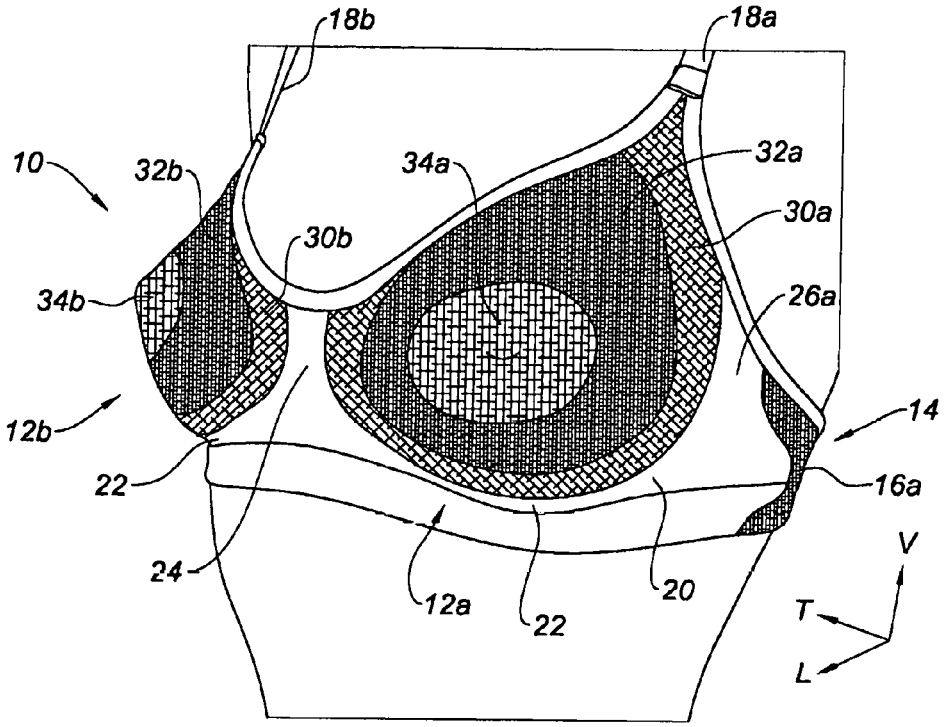
FIG. 1 is a perspective view, which illustrates a brassiere made of knit-fabric including a plurality of portions having variable elasticity, according to the invention.

Is shown in FIG. 1 a brassiere 10 made of knit-fabric which is shown in a configuration worn by a standing person, so that the transverse direction T shown by the trihedral L, V, T in FIG. 1 corresponds to a horizontal direction.

The brassiere 10 includes a first knitted cup 12*a* and a second knitted cup 12*b* which are transversely aligned and which have each a generally hemispherical shape, of a convexity oriented forward according to a longitudinal direction.

Figure 2:
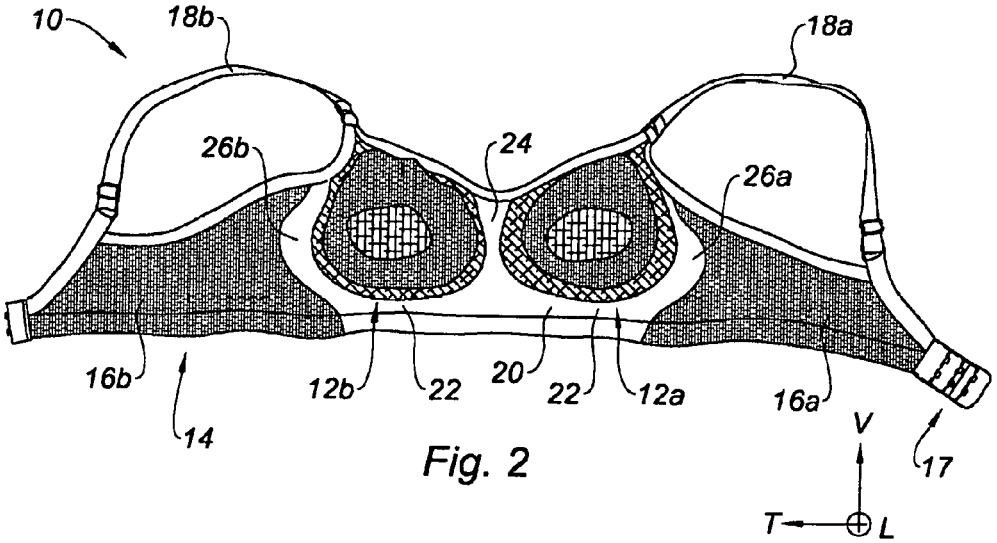
FIG. 2 is a plan view, which illustrates the brassiere of FIG. 1.

In addition, the brassiere 10 includes a strip 14 for attaching the back which is here composed of a first section 16*a* and of a second section 16*b* which are joinable together in the back of the user by a removable fastening means 17, shown in FIG. 2.

The fastening means 17 is of the clip and of the complementary notches type, for example.

However, without limitation, the brassiere 10 can also be designed to be fastened from the front, between the two cups 12*a*, 12*b*, according to a not shown design example.

Similarly, the brassiere 10 can be made of tube without fastening means, to be slipped through the head.

The strip 14 for attaching the back is made of knit-fabric extensible according to a transverse direction corresponding to its large length.

Moreover, the brassiere 10 is equipped with a pair of straps 18*a*, 18*b* which are designed to support the brassiere 10 on the shoulders of the user.

As it can be seen in FIGS. 1 and 2, the brassiere 10 includes a knit-fabric part 20 which is called "stiffener" 20 in the following of the description.

The stiffener 20 forms in particular an underwire strip 22 which extends under each cup 12*a*, 12*b* to promote the support and the holding of each cup 12*a*, 12*b*.

To this end, the underwire strip 22 of the stiffener 20 surrounds the lower periphery of each cup 12*a*, 12*b*, generally the lower half of each cup 12*a*, 12*b*.

In addition, the stiffener 20 forms a central strip 24 which connects the first cup 12*a* and the second cup 12*b* together so as to limit their transverse spacing relative to each other.

Also, the stiffener 20 forms a first side strip 26*a* which connects the first cup 12*a* on the first section 16*a*, and a second side strip 26*b* which connects the second cup 12*b* on the second section 16*b* of the attaching strip 14.

The stiffener 20 is made of knit-fabric according to a first stitch type 28 illustrated in FIG. 3 and described later, which is designed to replace an added underwire, such as a metal underwire, for example.

For this purpose, the first stitch type 28 of the stiffener 20 has a low or even null elastic extensibility, according to a vertical direction.

Here, "low elastic extensibility" means an extensibility which is inferior or equal to twenty percent, and preferably inferior or equal to ten percent relative to a rest state of the knit-fabric.

According to another aspect, each cup 12*a*, 12*b* includes, from the periphery toward the center of the cup, a first portion 30*a*, 30*b*, a second portion 32*a*, 32*b*, and a third portion 34*a*, 34*b* respectively.

The first portion 30*a*, 30*b* forms the lower periphery of each cup 12*a*, 12*b*, so as to support the chest.

As it can be seen in FIG. 1, the first portion 30*a*, 30*b* of each cup 12*a*, 12*b* surrounds substantially three quarters of each cup 12*a*, 12*b*, including a lower half and an upper outer side quarter, at the side of the arm of the user.

In addition, the first portion 30*a*, 30*b* of each cup 12*a*, 12*b* is elastically extensible and it is made of knit-fabric according to a second stitch type 36 which will be described afterward.

Moreover, the first portion 30*a*, 30*b* of each cup 12*a*, 12*b* has a vertical elastic extensibility superior to that of the stiffener 20.

Similarly, the first portion 30*a*, 30*b* of each cup 12*a*, 12*b* is sufficiently vertically responsive to lift the chest without crushing it.

The term "responsive" translates here a capacity to exert a vertically important restoring force when the knit-fabric is taut.

Complementarily, the second portion 32*a*, 32*b* of each cup 12*a*, 12*b* forms a ring which is arranged inside the first portion 30*a*, 30*b*.

In addition, the second portion 32*a*, 32*b* is elastically extensible according to a transverse direction and it has an elastic extensibility superior to that of the first portion 30*a*, 30*b*, so as to obtain a satisfactory depth of the cups 12*a*, 12*b*.

To this end the second portion 32*a*, 32*b* is made of knit-fabric according a third stitch type 38 which is described afterward.

Finally, the third portion 34*a*, 34*b* of each cup 12*a*, 12*b* forms a circle which is arranged at the center of the associated cup and which is surrounded by the second adjacent portion 32*a*, 32*b*.

In addition, the third portion 34*a*, 34*b* is elastically extensible and it has an elastic extensibility inferior to that of the second portion 32*a*, 32*b*.

To this end, the third portion 34*a*, 34*b* is made of knit-fabric according to a fourth stitch type 40 described afterward.

The different portions 30*a*, 30*b*, 32*a*, 32*b*, 34*a*, 34*b* of each cup 12*a*, 12*b*, the stiffener 20 and the strip 14 for attaching the back are made in one piece by circular knitting.

In addition, the different portions 30*a*, 30*b*, 32*a*, 32*b*, 34*a*, 34*b* of each cup 12*a*, 12*b* are arranged in a generally concentric way, as it can be seen in FIGS. 1 and 2.

In FIGS. 3 to 6 the visual rendering of a unit area 42 of the first stitch type 28, of the second stitch type 36, of the third stitch type 38 and of the fourth stitch type 40 respectively, is schematically shown, each unit area 42 being constituted of eight transverse rows of yarns forming eight vertical columns of knit-fabric.

The eight yarn rows of each knit-fabric stitch type are successively constituted of a covered yarn F1, a first polypropylene yarn F2, a first textured yarn F3, a second polypropylene yarn F4, flat yarn F5, a third polypropylene yarn F6, a second textured yarn F7 and a fourth polypropylene yarn F8.

It is meant by "covered yarn" a yarn constituted of a central part called core, and of a peripheral part called coverage.

The central part is an elastane or natural rubber yarn, for example, which gives the covered yarn elastic characteristics.

The peripheral part is made of natural fibers, such as cotton or wool, or is made of synthetic fibers, such as polyamide or polyester, for example.

However, according to the example described here, the covered yarn F1 includes an elastane central part and a polyamide peripheral part.

It is meant by "textured yarn" a flexible and voluminous yarn having elastic extensibility properties, unlike a flat yarn.

The textured yarn is for example obtained by twisting smooth fibers, usually synthetic, to increase the volume thereof, making it soft to touch and a bit extensible.

It is meant by "flat yarn" a yarn that does not stretch out, which is here made of polyester or of polyamide.

The flat yarn is a mono-filament yarn, as opposed to a textured yarn which is a multi-filaments. The flat yarn is obtained by spinning the material to a sufficient speed, usually comprised between 1000 meters per minute and 5000 meters per minute, and if necessary by means of a complementary stretching to obtain an amorphous yarn or having a low degree of crystallinity, usually less than 5 percent.

The extensibility of each stitch type 28, 36, 38, 40, in a transverse direction in the sense of the yarn, and in a vertical direction in the sense of the stitch, is determined by the nature of the used yarn and the made knit-fabric type.

Indeed, the stitches skipping technique, which comprises "keeping" a stitch on several rows, allows to vary the vertical extensibility of the knit-fabric.

The stitch skipping is illustrated in FIGS. 3 to 6, by the loops which extend vertically on a plurality of rows afterward. The more extended the stitch skipping is, the lower the intrinsic vertical elastic extensibility of the knit-fabric is.

Figure 3:
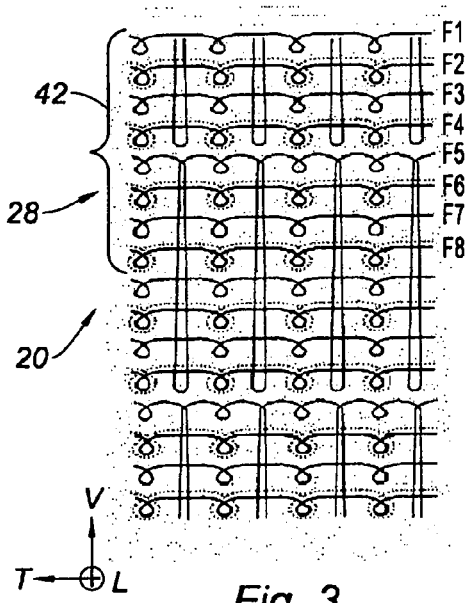
FIG. 3 is a schematic front view, which illustrates a first stitch type forming a stiffener.
Figure 4:
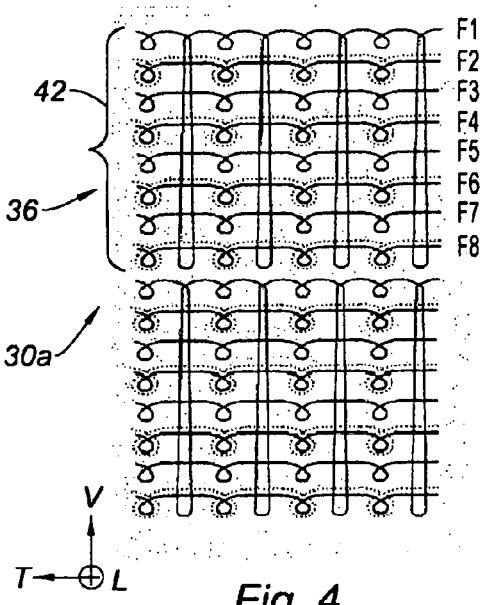
FIG. 4 is a schematic front view similar to FIG. 3, which illustrates a second stitch type forming a first portion of each cup.

As it can be seen in FIGS. 3 and 4, the first stitch type 28 and the second stitch type 36 include each a "kept" stitch on eight rows, alternating one column in every two.

The yarn of the kept stitch of the first stitch type 28 is the flat yarn F5, which does not stretch out, so that the first stitch type 28 has low or even null vertical elastic extensibility.

According to FIG. 4, the yarn of the "kept" stitch of the second stitch type 36 is the covered yarn F1, which is relatively elastic, so that the second stitch type 36 is too responsive vertically.

For indication, according to an exemplary embodiment, the second stitch type 36 has a vertical extensibility of one hundred and forty percent relative to a rest state.

Figure 5:
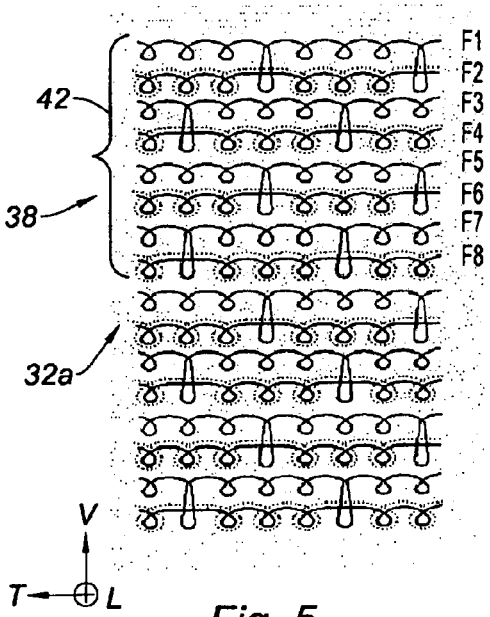
FIG. 5 is a schematic front view similar to FIG. 3, which illustrates a third stitch type forming a second portion of each cup.

As it can be seen in FIG. 5, which illustrates the third stitch type 38, the first covered yarn F1, and the third textured yarn F3, the flat yarn F5 and the textured yarn F7 are each "kept" on two rows, one column in every four, forming stitches skippings arranged in staggered rows.

Figure 6:
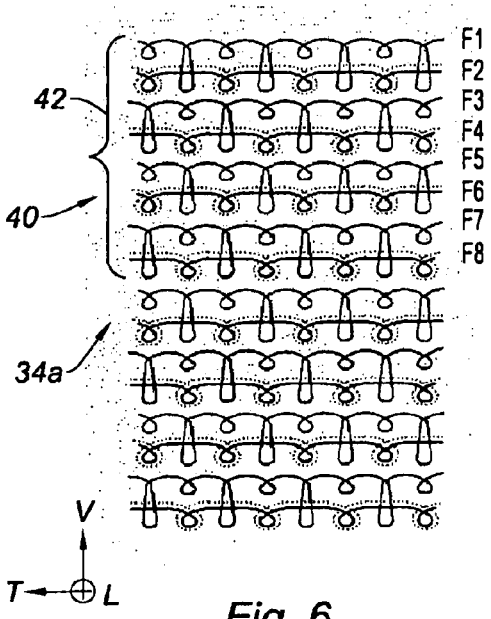
FIG. 6 is a schematic front view similar to FIG. 3, which illustrates a fourth stitch type forming a third portion each cup.

Similarly, according to FIG. 6 which illustrates the fourth stitch type 40, the first covered yarn F1, the third textured yarn F3, the flat yarn F5 and the textured yarn F7 are each kept on two rows, one column in every two, forming stitches skippings arranged in staggered rows.

Complementarily, the extensibility of each stitch type 28, 36, 38, 40, in a transverse direction, in the sense of the yarn, is determined by the number of stitches per unit area 42. The greater the number of stitches is, the higher the transverse elastic extensibility of the stitch tends to be.

Referring to FIGS. 3 to 6, the first stitch type 28 and the second stitch type 36 include each thirty six stitches per unit area 42, the third stitch type 38 includes fifty six stitches per unit area 42 and the fourth stitch type 40 includes forty eight stitches per unit area 42.

The high number of stitches of the fourth stitch type 40 allows to make the third central portion 34*a*, 34*b* of each cup 12*a*, 12*b* opaque, thus hiding the chest.

The vertical elastic extensibility characteristics relating to different stitch types 28, 36, 38, 40 are described afterward.

The first stitch type 28 has the lowest vertical extensibility, which is for example comprised between zero and twenty percent, and which is preferably equal to ten percent, or even zero percent, relative to a rest state.

The second stitch type 36 has a vertical extensibility which is superior to that of the first stitch type 28, and which is for example equal to one hundred and forty percent of stretching relative to a rest state.

The third stitch type 38 has a vertical extensibility which is superior to that of the second stitch type 36, and which is for example equal to one hundred seventy five percent of stretching relative to a rest state.

The fourth stitch type 40 has a vertical extensibility which is inferior to that of the third stitch type 38, and which is for example equal to one hundred and fifty percent of stretching relative to a rest state.

Concerning the transverse elastic extensibility characteristics relating to different stitch types 28, 36, 38, 40, the first stitch type 28 and the second stitch type 36 have a transverse extensibility lower than that of the third stitch type 38 and of the fourth stitch type 40, which is for example of seventy five percent of stretching relative to a rest state.

Finally, the transverse elastic extensibility of the third stitch type 38 and of the fourth stitch type 40 is, for example, of one hundred and seventy five percent of stretching relative to a rest state.

Thus, the brassiere 10 according to the invention allows to get free from an added underwire.

However, without limitation, the brassiere 10 according to the invention can be equipped with an added underwire to improve the chest holding.

In addition, the disposition of the different portions 30*a*, 30*b*, 32*a*, 32*b*, 34*a*, 34*b* of each cup 12*a*, 12*b* and of the stiffener 20, as well as the mechanical characteristics of each stitch type 28, 36, 38, 40 allow to offer an optimal chest holding.

According to a variant, not shown, the stiffener 20 surrounds the lower periphery of each cup 12*a*, 12*b*, as well as a part of the upper periphery of each cup 12*a*, 12*b*, to highlight the volume of the cups 12*a*, 12*b*.

The invention claimed is:

1. A brassiere made of knit-fabric, the brassiere comprising:

a first knitted cup and a second knitted cup which are transversely aligned and which have each a generally hemispherical shape, each cup of the first knitted cup and the second knitted cup including a first elastically extensible peripheral portion made of a knit-fabric, the first elastically extensible peripheral portion configured to support a chest of a wearer of the brassiere, a stiffener which extends at least partially under each cup of the first knitted cup and the second knitted cup, and a strip forming a back and sides of the brassiere, the strip configured for attaching at the back of the brassiere, wherein the stiffener forms an underwire strip which surrounds at least partially the first peripheral supporting portion of each cup, and the stiffener is made of knit-fabric according to a first stitch type; and wherein each cup of the first knitted cup and the second knitted cup includes a second inner annular portion adjacent to the first portion, the second inner annular portion being transversely and vertically elastically extensible, and has a vertical and transverse elastic extensibility greater than or equal to the elastic extensibility of the first portion.

2. The brassiere according to claim 1, wherein the stiffener has a first elastic extensibility less than or equal to twenty percent in a vertical direction, perpendicular to a transverse direction, so as to vertically support the chest.

3. The brassiere according to claim 1, wherein the first peripheral supporting portion of each cup has a vertical elastic extensibility greater than that of the stiffener.

4. The brassiere according to claim 1, wherein the stiffener and the first portion of each cup includes a first number of stitches per unit area less than a second number of stitches per unit area of the second portion of each cup, wherein the stiffener and the first portion are transversely less extensible than the second portion.

5. The brassiere according to claim 1, wherein each cup includes a third central portion which is adjacent to the second portion, which has a generally circular shape arranged generally at a center of the associated cup, and which has a vertical and transverse elastic extensibility less than the elastic extensibility of the second portion.

6. The brassiere according to claim 5, wherein the third portion includes a third number of stitches per unit area less than a second number of stitches per unit area of the second portion of each cup, wherein the third portion is transversely less extensible than the second portion.

7. The brassiere according to claim 1, wherein each portion of each cup is made of knit-fabric according to a different stitch type.

8. The brassiere according to claim 1, wherein the stiffener forms a central strip between the first knitted cup and second knitted cup, wherein the stiffener connects the first cup and the second cup together.

9. The brassiere according to claim 1, wherein the first portion of each cup, the stiffener, and the back strip form one circularly-knit piece.

10. The brassiere according to claim 5, wherein the second portion of each cup forms a ring arranged within the first portion of each cup.

11. The brassiere according to claim 10, wherein the third portion of each cup forms a circle arranged at the center of each cup and within the second portion of each cup of the first knitted cup and the second knitted cup.

12. The brassiere of claim 5, wherein the first portion, the second portion, and the third portion are concentrically arranged on each cup of the first knitted cup and the second knitted cup.

13. A brassiere made of knit-fabric, the brassiere comprising:

a first knitted cup and a second knitted cup which are transversely aligned and which have each a generally hemispherical shape, each cup of the first knitted cup and the second knitted cup including a first elastically extensible peripheral portion made of a knit-fabric, the first elastically extensible peripheral portion configured to support a chest of a wearer of the brassiere;

a strip forming a back and sides of the brassiere, the strip configured for attaching at the back of the brassiere; and wherein each cup of the first knitted cup and the second knitted cup includes a second inner annular portion which is adjacent to the first portion, the second inner annular portion being transversely and vertically elastically extensible, and having a vertical and transverse elastic extensibility greater than or equal to the elastic extensibility of the first portion; and wherein each cup of the first knitted cup and the second knitted cup includes a third central portion which is adjacent to the second portion, which has a generally circular shape arranged generally at a center of the associated cup, and which has a vertical and transverse elastic extensibility less than the elastic extensibility of the second portion.

14. The brassiere according to claim 13, comprising a stiffener extending at least partially under each cup of the first knitted cup and the second knitted cup, wherein the first portion of each cup of the first knitted cup and the second knitted cup includes a first number of stitches per unit area less than a second number of stitches per unit area of the second portion of each cup of the first knitted cup and the second knitted cup, wherein the stiffener and the first portion are transversely less extensible than the second portion.

15. The brassiere according to claim 13, wherein the third portion includes a third number of stitches per unit area less than a second number of stitches per unit area of the second portion of each cup of the first knitted cup and the second knitted cup, wherein the third portion is transversely less extensible than the second portion.

16. The brassiere according to claim 13, wherein each of the first elastically extensible peripheral portion, the second inner annular portion, and the third central portion of each cup of the first knitted cup and the second knitted cup are made of knit-fabric according to a different stitch type.

17. The brassiere according to claim 13, wherein the second portion of each cup forms a ring arranged within the first portion of each cup of the first knitted cup and the second knitted cup.

18. The brassiere according to claim 17, wherein the third portion of each cup forms a circle arranged at a center of each cup and within the second portion of each cup of the first knitted cup and the second knitted cup.

19. The brassiere according to claim 18, wherein the first portion, the second portion, and the third portion are concentrically arranged on each cup of the first knitted cup and the second knitted cup.

* * * * *